US012408721B2

(12) United States Patent
Garneau et al.

(10) Patent No.: US 12,408,721 B2
(45) Date of Patent: Sep. 9, 2025

(54) HELMET WITH SLIPPAGE PADS

(71) Applicant: LOLË BRANDS CANADA ULC, Montréal (CA)

(72) Inventors: Louis Garneau, Saint-Augustin-de-Desmaures (CA); Paul Isabelle, Saint-Augustin-de-Desmaures (CA)

(73) Assignee: LOLË BRANDS CANADA ULC, Montréal (CA)

( * ) Notice: Subject to any disclaimer, the term of this patent is extended or adjusted under 35 U.S.C. 154(b) by 396 days.

(21) Appl. No.: 16/268,918

(22) Filed: Feb. 6, 2019

(65) Prior Publication Data

US 2020/0008510 A1 Jan. 9, 2020

Related U.S. Application Data

(60) Provisional application No. 62/794,189, filed on Jan. 18, 2019, provisional application No. 62/782,022, (Continued)

(51) Int. Cl.
*A42B 3/12* (2006.01)
*A42B 3/06* (2006.01)

(52) U.S. Cl.
CPC ..... *A42B 3/12* (2013.01); *A42B 3/066* (2013.01)

(58) Field of Classification Search
CPC .. A42B 3/10; A42B 3/12; A42B 3/124; A42B 3/125; A42B 3/127; A42B 3/066;
(Continued)

(56) References Cited

U.S. PATENT DOCUMENTS 3,789,427 A * 2/1974 Aileo ..... A42B 3/10 2/423
3,877,076 A * 4/1975 Summers ..... A42B 3/124 2/414

(Continued)

FOREIGN PATENT DOCUMENTS

CN 201831005 U 5/2011
EP 2484238 A1 * 8/2012 ..... A42B 3/127
WO WO-2018138551 A1 * 8/2018 ..... A42B 3/124

OTHER PUBLICATIONS

European Search Report for corresponding application EP19155803; Report dated Jul. 11, 2019.

(Continued)

*Primary Examiner* — Uyen T Nguyen
(74) *Attorney, Agent, or Firm* — CANTOR COLBURN LLP

(57) ABSTRACT

There is provided a helmet with at least an inner liner forming a body of the helmet, the inner liner having a concave inner surface defining a cavity configured for receiving a wearer's head. The helmet has a plurality of slippage pads disposed at selected locations on the concave inner surface and connected to the inner liner. The slippage pads have an elongated shape with its length greater than its width. Each slippage pad defines a number of integrally connected side-by-side tubes each having an opening adapted to be oriented toward the wearer's head. The openings are aligned longitudinally along the length of the slippage pads. The helmet also has an attachment system to attach the helmet to the wearer's head.

22 Claims, 12 Drawing Sheets

Related U.S. Application Data filed on Dec. 19, 2018, provisional application No. 62/657,157, filed on Apr. 13, 2018, provisional application No. 62/626,913, filed on Feb. 6, 2018.

(58) Field of Classification Search

CPC .. A42B 3/06; A42B 3/00; A42B 3/063; A42B 3/064; A42B 3/128; A42B 3/121; A42B 3/122

USPC ..... 2/414

See application file for complete search history.

(56) References Cited

U.S. PATENT DOCUMENTS 4,534,068 A * 8/1985 Mitchell ..... A42B 3/124 2/420
4,558,470 A * 12/1985 Mitchell ..... A42B 3/124 2/414
8,566,968 B2 10/2013 Marzec
8,578,520 B2 11/2013 Halldin
9,585,432 B2 3/2017 Garneau
2006/0070170 A1* 4/2006 Copeland ..... A63B 71/10 2/412
2009/0178184 A1* 7/2009 Brine, III ..... A63B 71/10 2/424
2011/0107503 A1* 5/2011 Morgan ..... A42B 3/124 2/456
2012/0110720 A1* 5/2012 Mazzarolo ..... A42B 3/324 2/414
2013/0000015 A1* 1/2013 Marzec ..... A42B 3/064 2/411
2013/0086733 A1* 4/2013 Szalkowski ..... A42B 3/12 2/414
2013/0263363 A1* 10/2013 Pietrzak ..... A42B 3/066 2/411
2013/0291289 A1* 11/2013 Szalkowski ..... A42B 3/12 2/414
2014/0007324 A1* 1/2014 Svehaug ..... A42B 1/08 2/412
2014/0223641 A1* 8/2014 Henderson ..... A42B 3/065 2/411
2015/0033453 A1* 2/2015 Pannikottu ..... B32B 5/18 2/413
2015/0305430 A1* 10/2015 Rush ..... A42B 3/125 2/412
2016/0021966 A1* 1/2016 Warmouth ..... A42B 3/105 2/413
2016/0113348 A1* 4/2016 Twardowski, Jr. ... F41H 5/0492 2/412
2016/0316847 A1* 11/2016 Weber ..... A42B 3/125
2016/0324247 A1* 11/2016 Warmouth ..... A42B 3/20
2017/0303612 A1* 10/2017 Morgan ..... B65D 65/403
2018/0132556 A1* 5/2018 Laperriere ..... A42B 3/121
2018/0153244 A1* 6/2018 Kirshon ..... B29C 39/025
2018/0213875 A1* 8/2018 Tutunaru ..... A42B 3/128
2018/0343953 A1* 12/2018 Erb ..... A42B 3/064
2019/0014848 A1* 1/2019 Tutunaru ..... A42B 3/0406
2019/0328073 A1* 10/2019 Morgan ..... F16F 3/087

OTHER PUBLICATIONS

Examination Report for corresponding Canadian application 3033306; Report dated Apr. 24, 2019.

* cited by examiner

HELMET WITH SLIPPAGE PADS

CROSS-REFERENCE TO RELATED APPLICATIONS

The present application is related to and claims the benefit of U.S. Provisional Patent Application Nos. 62/626,913, filed on Feb. 6, 2018, 62/657,157, filed on Apr. 13, 2018, 62/782,022, filed on Dec. 19, 2018, and 62/794,189, filed on Jan. 18, 2019, the entire content of each of which said applications is incorporated herein by reference.

TECHNICAL FIELD

The present application relates to sport helmets, such as bicycle helmets.

BACKGROUND OF THE ART

Bicycle helmets have now become ubiquitous for the bicycling activity, and other sports. In road and urban bicycle riding, one specific helmet construction is commonly used: that consisting of the foam inner liner with an outer shell. The inner liner forms the body of the helmet in terms of volume and structural integrity. The inner liner is typically made of a structural foam material such as expanded polystyrene. An outer shell covers the liner and defines the smooth, aerodynamic and/or decorative exposed outer surface of the helmet. The outer shell and liner are most often co-molded, and additional structural and attachment components. Other components include the attachment system inside the outer shell, by which the helmet is secured to the user's head. The above-referred configuration is quite convenient in terms of providing suitable head protection, while being lightweight.

However, while protecting the head from some form of traumatic injuries such as skull fractures and skin wounds, helmets may leave the wearer exposed to some other forms of trauma, such as concussions. For example, angled impacts on one's head may result in a concussion, in spite of the presence of a helmet. Accordingly, some technologies have been developed to assist in absorbing shocks, such as that described in U.S. Pat. No. 8,578,520. It describes the presence of an attachment device that accommodates the wearer's head. The attachment device is a low-friction layer that creates a relative motion between the inner liner and the skull, at a point of angled contact. Hence, rotational energy is directed away from the brain, so as to reduce the strain in the brain tissue at an impact.

SUMMARY

Therefore, it is an aim of the present disclosure to provide a helmet that addresses issues associated with the prior art.

In accordance with an aspect, there is provided a helmet comprising: at least an inner liner forming a body of the helmet, the inner liner having a concave inner surface defining a cavity configured for receiving a wearer's head; a plurality of slippage pads disposed at selected locations on the concave inner surface and connected to the inner liner, the slippage pads having an elongated shape with a length and a width, the length being greater than the width, the slippage pads each defining a number of integrally connected side-by-side tubes each having an opening adapted to be oriented toward the wearer's head, the openings aligned longitudinally along the length of the slippage pads and an attachment system to attach the helmet to the wearer's head.

Further in accordance with this aspect all the slippage pads are, for instance, shaped and size to be identical to each other.

Still further in accordance with this aspect, lateral pairs of the slippage pads are, for instance, disposed on each side of a sagittal plane of the helmet.

Still further in accordance with this aspect, the lateral pairs of the slippage pads are, for instance, evenly laterally spaced apart from the sagittal plane of the helmet.

Still further in accordance with this aspect, a frontal pair of the slippage pads is, for instance, disposed in a frontal portion of the helmet.

Still further in accordance with this aspect, the helmet further comprises, for instance, at least one cushioning pad disposed on the concave inner surface of the inner liner.

Still further in accordance with this aspect, the cushioning pad has apertures defined therethrough, for instance, the apertures corresponding in shape and dimensions to the slippage pads, for instance, some of the slippage pads are disposed within the apertures of the cushioning pad.

Still further in accordance with this aspect, the cushioning pad and the slippage pads disposed within the apertures form, for instance, a continuous surface adapted to be oriented toward the wearer's head.

Still further in accordance with this aspect, recesses are defined within the inner liner, for instance, the slippage pads have a base portion received in respective ones of the recesses, the slippage pads having a head contacting portion projecting beyond a surrounding surface of the inner liner, for instance.

Still further in accordance with this aspect, the recesses and the slippage pads are, for instance, dimensioned for lateral walls of the slippage pads to contact surfaces of the recesses.

Still further in accordance with this aspect, a peripheral space is defined between lateral walls of the recesses and a periphery of the slippage pads, for instance, to allow the slippage pads to expand laterally while being compressed until the periphery of the slippage pads abuts against the lateral walls of the recesses.

Still further in accordance with this aspect, a ratio of a recess depth over a thickness of the slippage pads is between 1:2 and 1:4, for instance.

Still further in accordance with this aspect, the slippage pads have a length of 40 mm±20 mm, and a width of 13 mm±7 mm, for instance.

Still further in accordance with this aspect, a thickness of the slippage pads ranges between 2 mm and 10 mm, for instance.

Still further in accordance with this aspect, a density of the slippage pads is 0.27 $g/cm^3 \pm 0.10$ $g/cm^3$, for instance.

Still further in accordance with this aspect, the slippage pads are made of, for instance, a composite material including polyurethane and a non-Newtonian polymeric material.

Still further in accordance with this aspect, the slippage pads are each formed as an integral monolithic piece of a non-Newtonian polymeric material, for instance.

Still further in accordance with this aspect, the plurality of tubes is a pair of tubes, for instance, the openings of the pair of tubes each having an obround shape, for instance.

Still further in accordance with this aspect, the openings have a length of 15 mm±5 mm and a width of 5 mm±3 mm, for instance.

Still further in accordance with this aspect, a ratio of the sum of a length of the openings over the length of the slippage pad is 70%±20%, for instance.

Still further in accordance with this aspect, a ratio of a width of the openings over the width of the slippage pad range between 25% and 40%, for instance.

Still further in accordance with this aspect, at least a first and a second one of the slippage pads are longitudinally oriented in a front-to-rear direction of the helmet, for instance, the at least two slippage pads having a respective longitudinal projection extending between the opposite lateral portions of the helmet.

Still further in accordance with this aspect, the inner liner is made of, for instance, expanded polystyrene.

DESCRIPTION OF THE DRAWINGS

FIG. 9 is a top view of a cluster of slippage pads shown in FIGS. 7-8;

DETAILED DESCRIPTION

Figure 1:
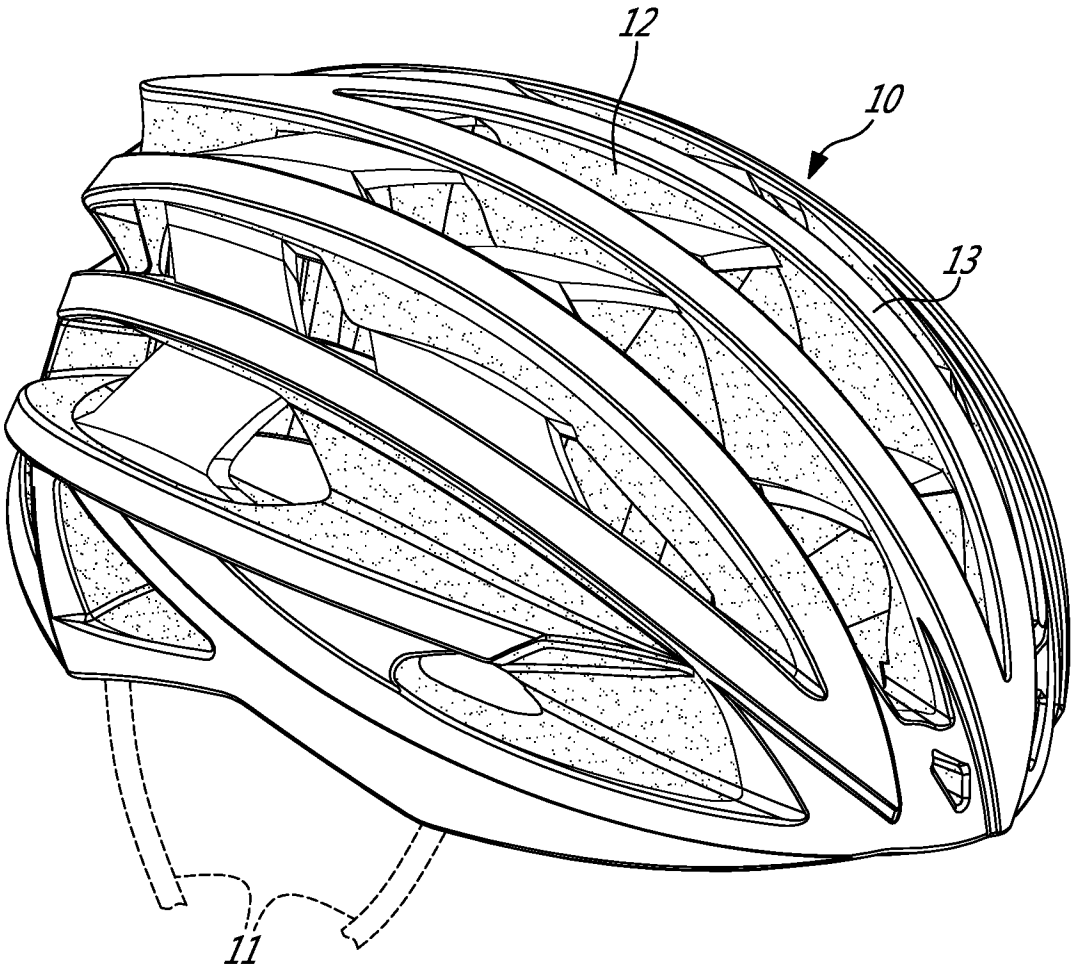
FIG. 1 is a perspective view of a helmet with a slip plane system in accordance with an embodiment of the present disclosure.

Referring to the drawings, and more particularly to FIG. 1, there is illustrated a helmet 10 in accordance with the present disclosure. The helmet 10 is of the type that is used for bicycling and like sporting activities.

For simplicity, an attachment system is only summarily shown as 11. The attachment system is typically anchored to an interior of the helmet and features straps for the helmet to be strapped to the user's head. The attachment system may also comprise rigid attachment components in the rear of the helmet, to adjust the helmet to a circumference of the wearer's head. Hence, although summarily shown, the helmet 10 has such attachment means of any appropriate form.

The helmet 10 has a generally hemispherical shape formed by an inner liner 12 and an outer shell 13. By its hemispherical shape, the helmet 10 has an inner concave surface and outer convex surface, with the top and side of the wearer's head being received in the inner concavity.

The inner liner 12 is typically made of foam (e.g., expanded polystyrene or the like) and constitutes the major component of the helmet 10 in terms of volume and energy absorption capability: it is the structure of the helmet 10. Moreover, the foam is of the type being generally rigid and hence providing the structural integrity to the helmet 10, in terms of maintaining its shape. In other words, the foam liner is not of the resilient type that is supported by a rigid shell, but rather of the type that is the main structural component of the helmet 10. It is by the combination of the attachment system 11 and the inner liner 12 that the helmet 10 remains attached to the wearer's head. The inner liner 12 covers an upper portion of the head, and the attachment system 11 prevents the inner liner 12 from being pulled off (in translation). However, some play may be present between the head of the wearer and the inner liner 12, due to the somewhat complementary spherical shapes. The play is used for assisting in absorbing angled impacts on the helmet.

The outer shell 13 is integrally connected to the inner liner 12 and forms the major portion of the exposed convex surface of the helmet 10. The integral connection may be achieved by way of adhesives or co-molding (i.e., molding of the inner liner 12 with the outer shell 13 positioned in the mold cavity beforehand). The outer shell 13 is made of a plastic layer, such as polycarbonate or the like. The outer shell 13 defines the smooth and decorative outer surface of the helmet 10. Other components may be present, such as a cage, as described in U.S. patent application Ser. No. 14/049,375, the contents of which are incorporated herein by reference. Also, the helmet 10 may have an inner liner 12, but no other shell 13, or multiple shell segments, among other possible variants.

Figure 2:
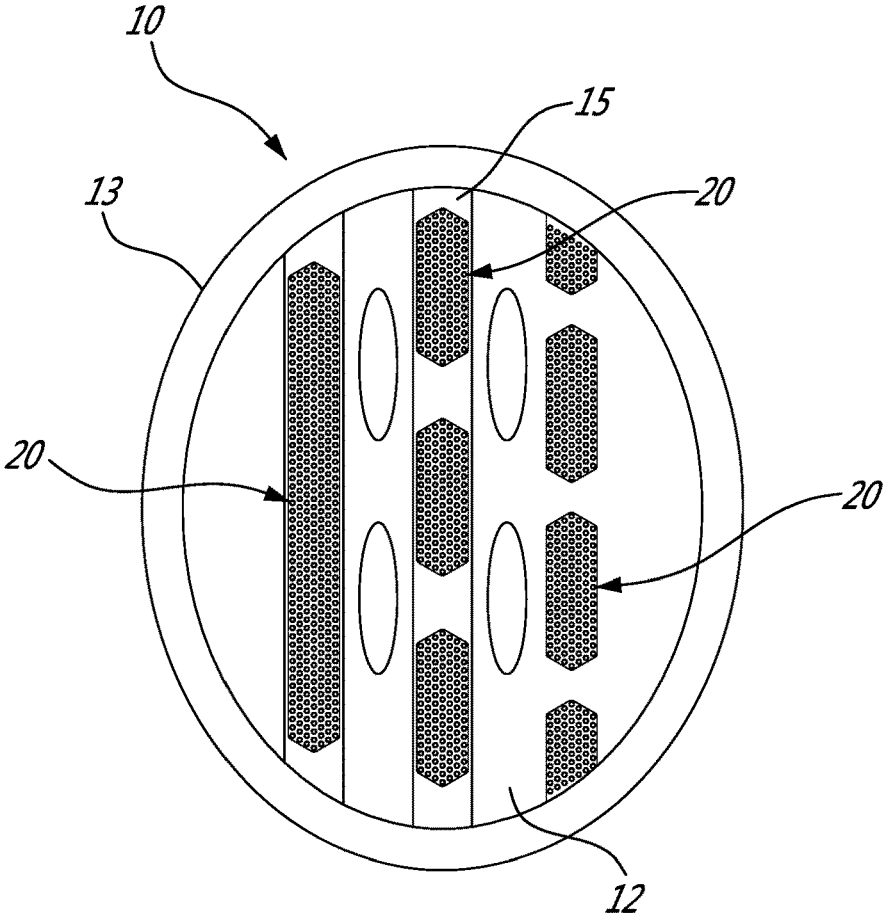
FIG. 2 is a schematic view of an inner cavity of the helmet of FIG. 1 showing a distribution of the slippage pads.

Referring to FIG. 2, an interior of the helmet 10 is shown, with the attachment system 11 removed for simplicity. Vents 14 are shown as being defined at least partially by the inner liner 12, and allow air circulation in and out of the helmet 10. Cushioning pads 15 may be distributed at various locations in the interior of the helmet 10. A plurality of slippage pads 20 are distributed in the inner cavity of the helmet 10. The cushioning pads 15 and the slippage pads 20 are padding interfaces between a surface of the inner cavity of the inner liner 12 and the wearer's head. The cushioning pads 15 and slippage pads 20 serve no function of attachment of the helmet 10 to the wearer's head. The cushioning pads 15 and slippage pads 20 provide cushioning to make the helmet 10 more comfortable, and may hence reduce some of the play between the inner liner 12 and the wearer's head. The cushioning pads 15 and the slippage pads 20 may also perform some management of the linear and rotational forces and movement that occur upon impact on the helmet 10.

Moreover, the slippage pads 20 may allow a relative slippage motion between the surface of the inner liner 12 and the head of the wearer, in quasi-translational manner. As the surface of the inner liner 12 is concave, it is not fully flat. Hence, the movement depicted by the arrows is not purely translational, but close to a translation, explaining the use of the expression quasi-translational, as well as the expression slip plane system, as non-flat planes of the inner liner 12 and of the skull of the wearer may move relative to one another. The movement may also be described as a sliding movement of a part of the slippage pads 20 relative to the concave surface of the inner liner 12. It is the resistance of this sliding movement that allows absorption of angled impacts on the helmet 10.

Figure 3:
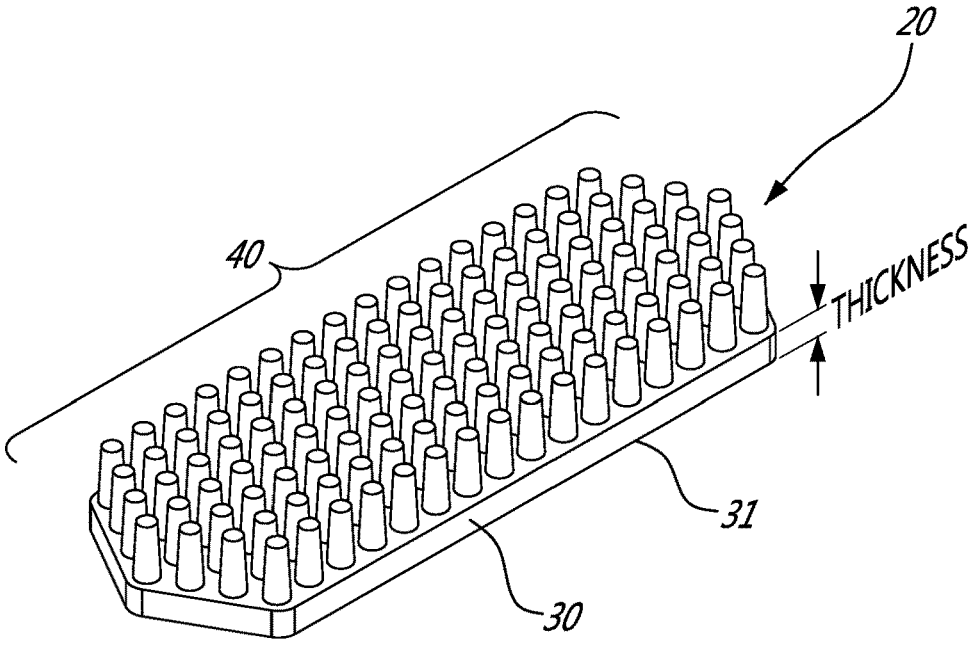
FIG. 3 is a perspective view of a slippage pad as used in FIG. 2.

Referring to FIG. 3, an embodiment of the slippage pad 20 is shown. The slippage pad 20 has a base 30 and a plurality of bristles 40 projecting from the base 30. In an embodiment, the base 30 and bristles 40 are a monoblock piece made of a single material, although it is contemplated to assemble the base 30 and bristles 40 from separate components, such as in a brush. The base 30 is the interface of the slippage pad 20 with the inner liner 12 of the helmet, i.e., the component by which the slippage pad 20 is secured to the foam of the inner liner 12, or other structural component if the helmet 10 does not have a foam inner liner 12. For example, the base 30 may be glued, fused, etc to the liner 12. Some attachment means may also be provided, such as an adhesive, complementary strips of patches of hooks and loops, for example. The base 30 may also be comolded with the inner liner 12, or may be inserted after the molding of the inner liner 12. The base 30 may be a resilient pad (e.g., gel pad, foam pad, fluid in a membrane). Other configurations are possible as well.

The base 30 may have any appropriate shape, such as a disk, square, obround, etc. For example, as in FIG. 3, the base 30 may have an elongated shape, such as an elongated hexagon, as one possible embodiment, or even an elongated strip that extends a substantial portion of the longitudinal direction of the helmet 10, as shown in FIG. 2. The undersurface 31 of the base 30 may be generally planar or may conform to the shape of the surface of the inner liner 12. In an embodiment, such as in FIG. 3, the bristles 40 are normal to a plane of the base 30, i.e., taking into consideration that the base 30 may not be flat. Assuming that the base 30 when installed has local curvatures, the bristles 40 are radially oriented relative to local curvatures of the base 30.

The bristles 40 are the slippage components, and may have other names, such as upstanding or elongated members, hairs, filaments, posts, etc. Referring to FIGS. 5A to 5D, the bristles 40 may be shown as having three portions, namely a connection end portion 40A by which the bristles 40 are connected to the base 30, an elongated body portion 40B, and a free end portion 40C. FIGS. 5A to 5D illustrates non-exhaustively various possible shapes for the bristles 40, such as with a larger connection end portion 40A, a global taper, or a straight body, and even with an enlarged free end portion 40C. The bristles 40 are relatively density distributed on the base 30, so as to form a brush-like configuration. The bristles 40 may therefore move in multiple directions, which can be generally described as having the free end portions 40C move along an imaginary sphere surface trajectory. The bristles 40 may also buckle as a result of compressive forces, in such a way that the free end portions 40C move toward the base 30, such that the slippage pads 20 may also provide cushioning.

Figure 6:
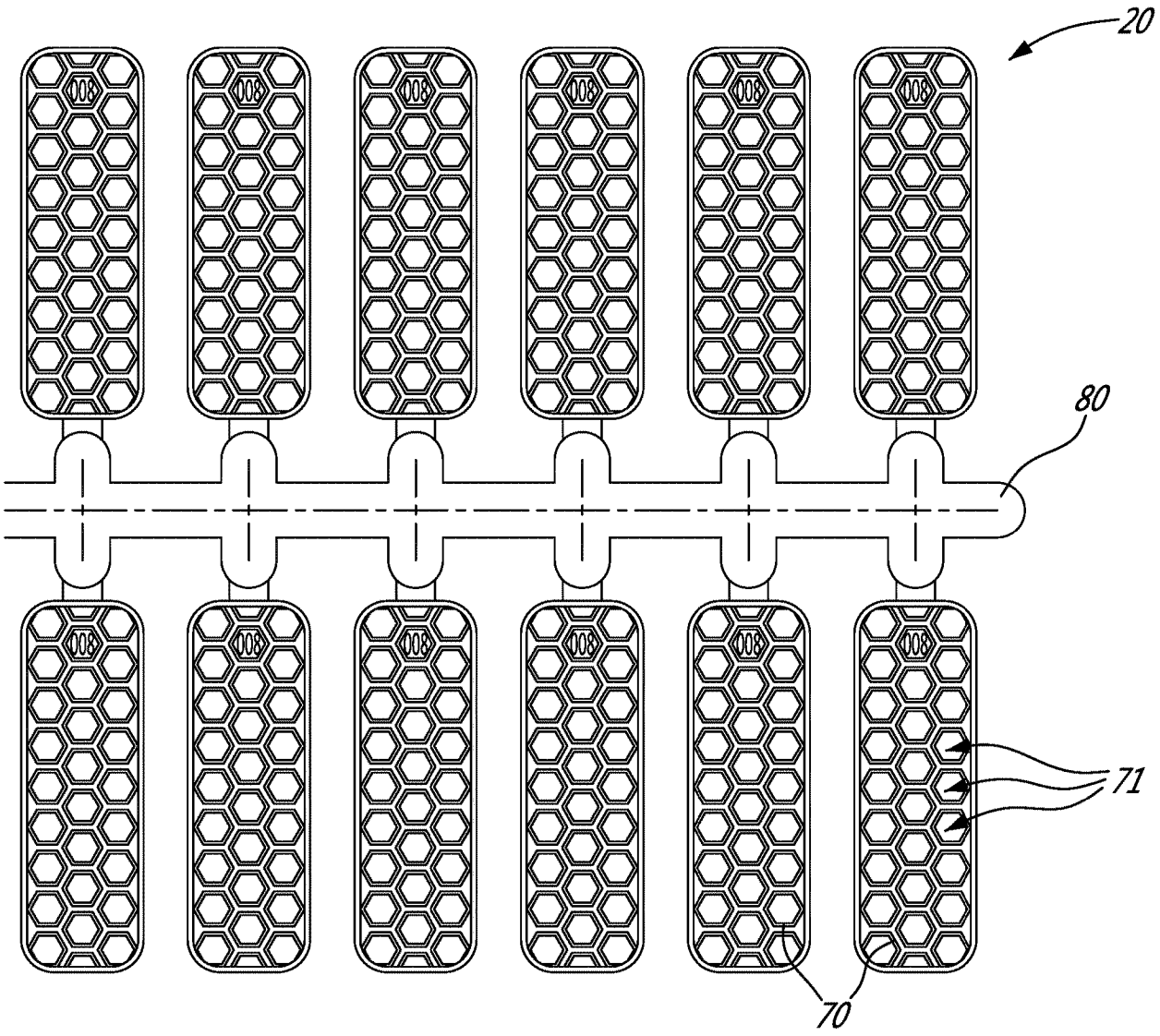

The preceding figures show the slippage pads 20 with the bristles 40 defining the exposed surface. It is optionally considered to provide a membrane on top of the bristles 40 so as to separate a user's head from direct contact with the tips of the bristles 40. Referring to FIG. 6, there is shown such a membrane at 50, the membrane 50 may be used with any appropriate configuration of the bristles, for instance the bristles of FIG. 5A to 5D. In accordance with an embodiment, the membrane 50 is a non-rigid fabric or light material, figures such as polyester, nylon, cotton, polymers. The membrane 50 may simply be laid upon the tips of the bristles with any appropriate connection between the base 30, the bristles 40 and/or the membrane 50. For example, the membrane may fully encapsulate the bristles 40 by being connected at its extremities to the base 30. As another example, the membrane 50 may be secured to peripheral bristles. As yet another example, the base 30 may define a wall 51 projecting upwardly in the same direction as the bristles 40, but not all the way to the tip of the bristles, with the membrane 50 connected to it. As yet another example, the membrane 50 is a pocket in which the base 30 and the bristles 40 are encapsulated. Such a slippage pad 20 would have for example Velcro™ or like connection means to be secured to the helmet 10.

The material of the bristles 40, and of the base 30 when the base 30 and the bristles 40 form a monoblock piece of a single material, is selected to be compliant and have flexibility, i.e., be capable of movements in the elastic deformation range, to then regain the shape of FIG. 2. For example, materials such as moldable rubbery polymers are well suited for being used as material of the slippage pads 20. Materials include silicone, polyethylene, polypropylene, and natural materials such as rubber. According to an embodiment, the slippage pad 20 is an integrally monolithic piece, such as a molded unitary piece. A composite slippage pad 20 may also be formed. Accordingly, the bristles 40 have the capacity of elastically returning to their initial unloaded shapes, for "lateral" movements of the free end portions 40C (i.e., an imaginary sphere surface trajectory), and for distorting, flexing, shearing and/or buckling.

Figure 4:
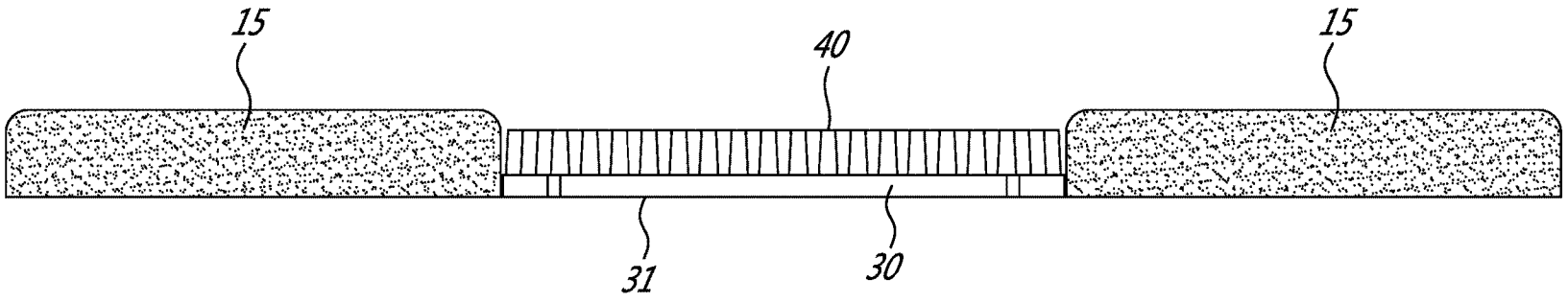
FIG. 4 is a sectional schematic view of one of the slippage pads between a pair of cushioning pads.
Figure 5:
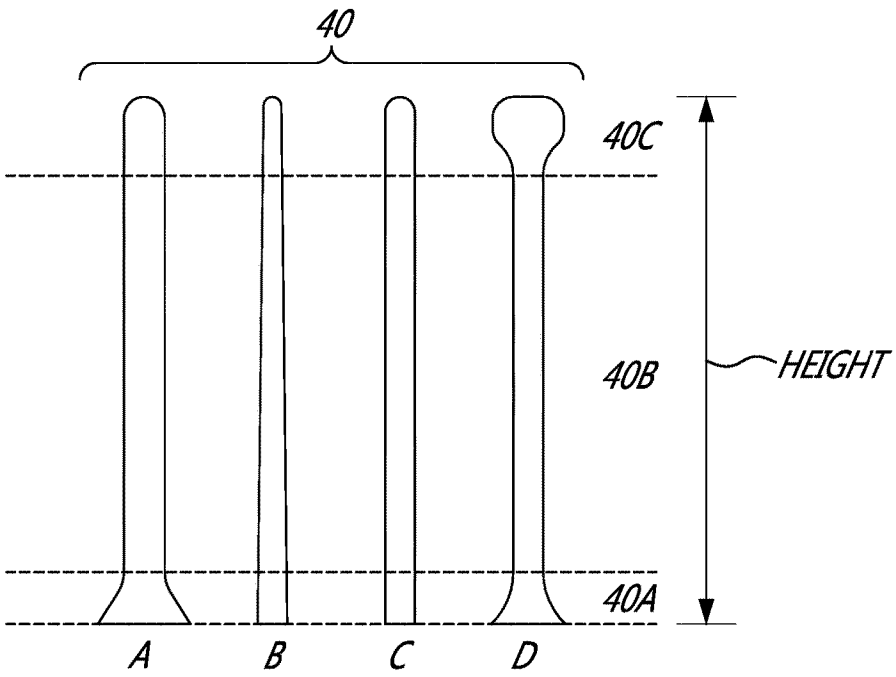
FIG. 5 is a schematic elevation view of embodiments of bristles of the slippage pads.
Figure 6A:
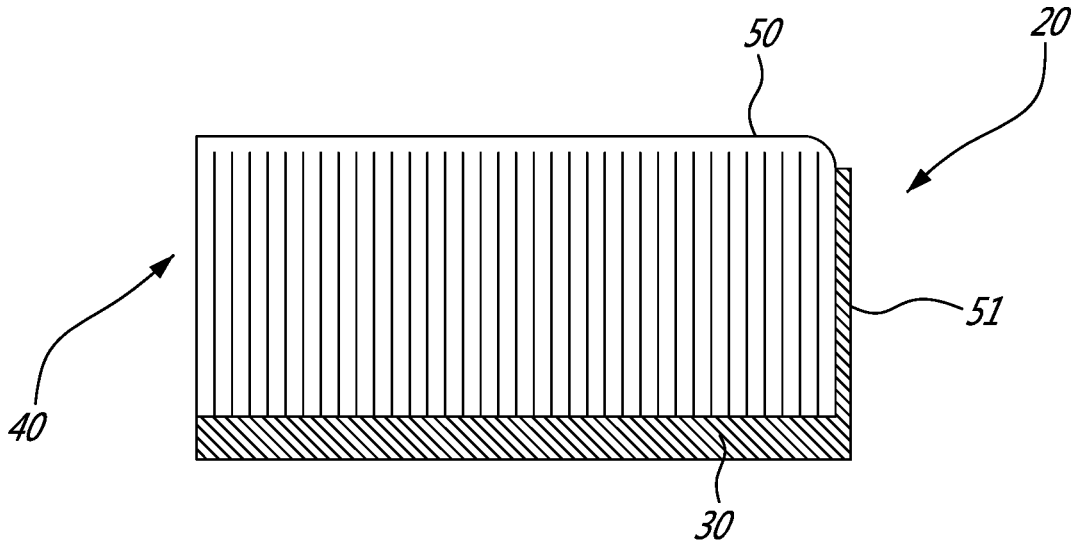
FIGS. 6A-6B are schematic views of one of the slippage pads between a pair of cushioning pads, in accordance with another embodiment of the present disclosure.
Figure 6B:
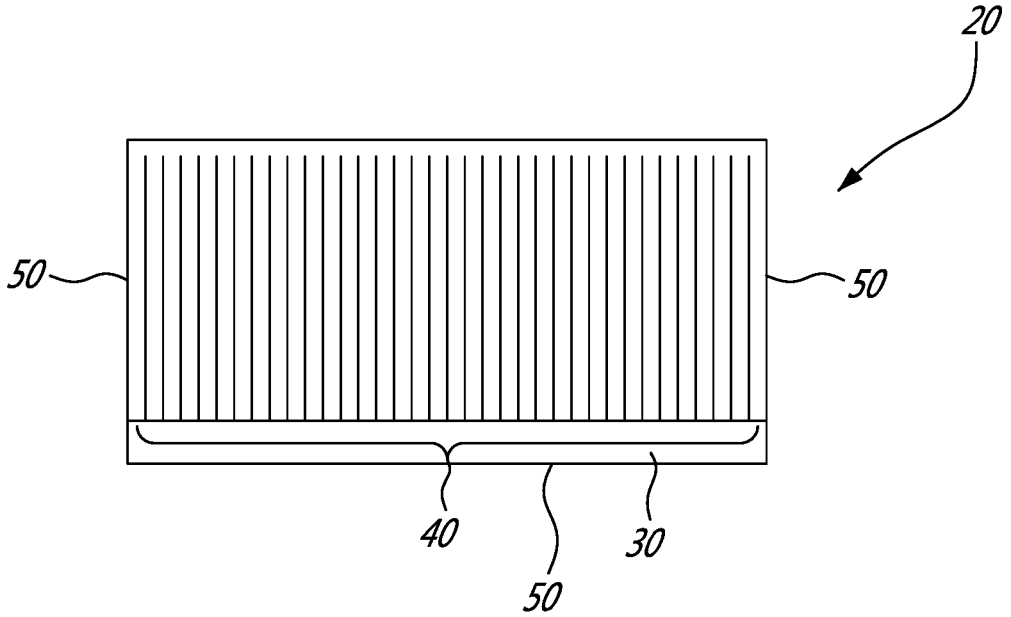

In terms of dimensions, the length of the bristles 40 may range from 1.0 mm to 7.0 mm in an embodiment, although it is contemplated to have longer bristles 40 as well. The thickness of the base 30 may range from 0.3 mm to 3.0 mm, although it is contemplated to have a thicker base 30 as well. In an embodiment, as shown in FIG. 4, the slippage pads 20 are thinner than the cushioning pads 15 in a rest condition of the pads 15. However, it is also contemplated to have the pads 20 thicker than the pads 15. However, the bristles 40 may have a slightly greater rigidity than the cushioning pads 15 such that the pads 15 collapse when a load is applied, for the bristles 40 to oppose their rigidity against loads. Slippage pads 20 may therefore be located between cushioning pads 15, for the cushioning pads 15 to form the leading interface surface of the helmet 10 with the wearer's head. The slippage pads 20 may also be used on their own, as in FIG. 2.

Due to the cushioning and the deformation, the bristles 40 may provide a non-negligible level of friction with the wearer's head (skin and/or hair, or cap or fabric), such that an angled impact on the helmet 10 will result in deformation of the bristles 40 relative to the wearer's head. In other words, an angled impact on the helmet 10 may result in a movement resulting from deformation of the bristles 40 and relative movement of free ends of the bristles 40 relative to the inner liner 12. An embodiment with the enlarged free end portion 40C may assist in ensuring suitable friction between the wearer's head and the bristles 40. A high enough density of bristles 40 per surface unit of the base 30 may also assist.

Therefore, when an angled impact is made on the helmet 10, the slippage pads 20, in contact with various discrete locations of the wearer's head, will allow displacement of the inner liner 12 relative to the wearer's head, by deformation of the bristles 40, while the bases 30 generally remain at the discrete locations on the helmet. This displacement of the inner liner 12 relative to the wearer's head will lessen the rotational velocity movement on the wearer's head. The slippage pads 20 are independent from one another, as they are not concurrently related to an attachment device. In other words, each slippage pad 20 will enable local deformation independently of how the other slippage pads 20 react. As mentioned previously, the deformation may be in the form of flexion and/or buckling of the bristles 40.

Figure 7:
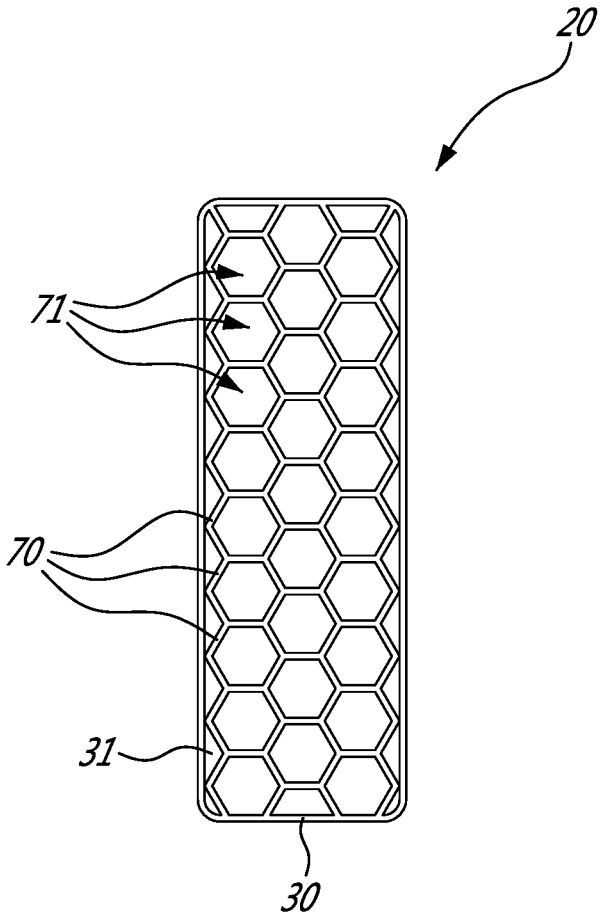
FIG. 7 is a top view of a slippage pad as used in FIG. 2, in accordance with another embodiment of the present disclosure.
Figure 8:
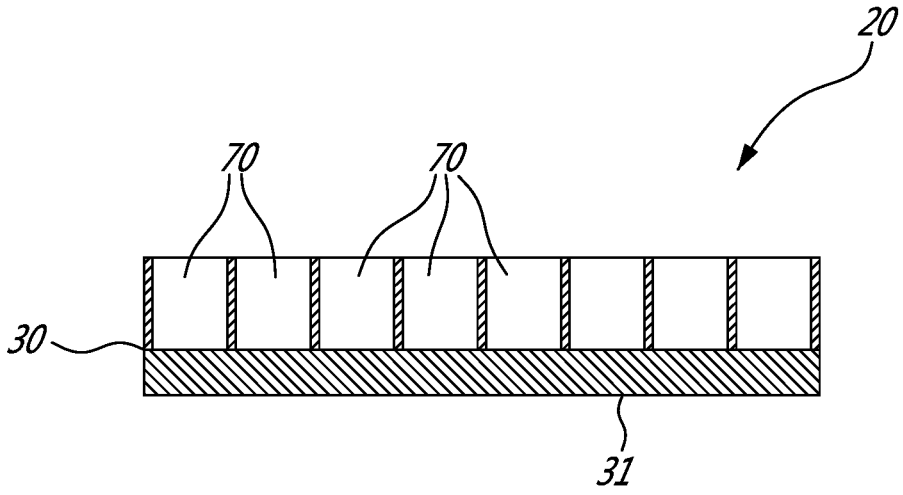
FIG. 8 is an elevation view of the slippage pad of FIG. 1.

Referring to FIGS. 7 and 8, another slippage pad is shown, at 20. The slippage pad 20 of FIGS. 7 and 8 may or may not have a base 30, by which an undersurface 31 of the slippage pad 20 may be attached to a helmet, in the manners described above. In this embodiment, a plurality of side-by-side tubes 70 form the body of the slippage pad 20. As in FIG. 7, the tubes 70 may have an hexagonal cross-section, with adjacent tubes 70 sharing walls to form a honey-comb style structure, i.e. with an opening 71 facing the head of the wearer. Central tube axes are generally parallel to one another and normal to a main plane of the slippage pad 20, though the plane may not be flat during use. All central axes are oriented toward the wearer. However, other cross-sectional shapes for the tubes 70 are contemplated as well, including square, circular, triangular, diamond, etc. In FIGS. 7 and 8, it is observed that there are no interstitial spaces between the tubes 70, as adjacent tubes 70 have walls in common. Such interstitial spaces could trap hair, which could cause discomfort for the wearer of the helmet 10. As another way to consider the pad 20 of FIGS. 7 and 8, it may be regarded as block of a resilient material, in which an array of holes with opening(s) 71 are made in its main surface(s). In an embodiment where the base 30 is present, the openings 71 may extend through the base 30. However, in some embodiments, the openings 71 may not extend all the way through the slippage pad 20 and/or the base 30 of the pad 20.

The dimensions of the slippage pad 20 may be any appropriate dimension for use in a helmet 10. In an embodiment, the pads have an elongated shape with a length of 4.0 cm±2.0 cm, and a width of 1.3 cm±0.5 cm. However, the elongated shape is not necessary. The slippage pad 20 may have any other shape or configuration, with the dimensions ranging between 0.8 cm and 20.0 cm, though they may even be larger. As shown in FIG. 8, the thickness may be of 0.5 cm+1.0 cm-0.2 cm. This may or may not include the base 30. In an embodiment, the base 30 has a 1 mm thickness. A widest dimension of the tubes 70 (e.g., from diametrically opposed apex, may be 4.0 mm 1.0 mm, although it may be more or less than that.

The slippage pad 20 of FIGS. 7 and 8 may be integrally molded into a resilient elastomer. The material of the tubes 70, and of the base 30 when the base 30 and the tubes 70 form a monoblock piece of a single material, is selected to be compliant and have flexibility, i.e., be capable of movements in the elastic deformation range, to then regain the shape of FIG. 2. For example, materials such as moldable rubbery polymers are well suited for being used as material of the slippage pads 20. Materials include silicone, polyethylene, polypropylene, TPU and natural materials such as rubber. The slippage pad 20 may also be made of a non-Newtonian polymer, in a gel or fluid form, for instance. In a particular embodiment, the slippage pad 20 is made of the non-Newtonian polymer known as DCLAN™ gel commercialized by Dongguan DCLAN Technology Co., Ltd. Such non-Newtonian polymer may harden from a non-rigid state (i.e. a gel state) to form an impact protection layer while absorbing, at least partially, the impact energy. This may occur when hydrogen bonds between molecules of the DCLAN gel temporarily break (e.g. break or separate), whereby the impact energy may dissipate.

According to an embodiment with the tubes 70, the slippage pad 20 is an integrally monolithic piece, such as a molded unitary piece. The slippage pad 20 may be manufactured using any suitable manufacturing technique. In one particularly embodiment, the slippage pad 20 is formed using additive manufacturing technique, such as 3D printing. In another particular embodiment, the slippage pad 20 is formed using injection molding. As shown in FIG. 9, the slippage pad 20, when formed by injection molding, though other manufacturing techniques may provide similar results, may be molded as a cluster of slippage pads 20 separated from one another, but interconnected in between them via a web 80 connected to the slippage pads 20. In other words, the web 80 and the slippage pads 20 form an integrally monolithic piece, such as a molded unitary piece. That is, the web 80 and the discrete slippage pads 20 are formed, in such embodiment, as a single cluster of slippage pads 20 interconnected to one another and integrally molded as a monolithic piece. The web 80 and the slippage pads 20 are made of the same material, although a composite web 80 and slippage pads 20 assembly may also be formed of different materials.

Having a cluster of slippage pads 20 interconnected to one another may allow easier and/or more convenient handling of the slippage pads 20 during the manufacturing and/or packaging steps, for instance. Each slippage pad 20 of the cluster may then be manually separated, or mechanically separated, for instance, from said cluster for individually installing/positioning them in a helmet 10, or for passing through one or more additional manufacturing steps. Although the slippage pads 20 shown in FIG. 9 are of the type shown in FIGS. 7 and 8, the slippage pads 20 may take the form of any contemplated slippage pads 20.

In some cases, the web 80 and the slippage pads 20 may be directly installed in a helmet 10, as a single slippage pad 20 assembly. For instance, the web 80 and the slippage pads 20 shown in FIG. 9 may be secured to the inner liner 12 of the helmet 10, as discussed above with respect to other embodiments. More particularly, in an embodiment, the web 80 and the slippage pads 20, are secured to the inner liner 12 such that the web 80 extends along a substantial portion of the longitudinal direction of the helmet 10, and where the slippage pads 20 are distributed on opposite sides of the web 80 and positioned in the helmet 10 to overlay the opposite temporal portions of the wearer's head. In other words, in this configuration, the slippage pads 20 are distributed on opposite sides of a longitudinal central axis of the helmet 10. In such an embodiment, the web 80 and the slippage pads 20 may be secured to the inner liner 12 using known connection means such as discussed earlier above. For instance, where the web 80 and the slippage pads 20 are removably connected to the inner liner 12, by Velcro™ or otherwise, the web 80 with the slippage pads 20 may be purchased and installed in helmets not initially designed with such energy absorption features, such as is the case for conventional bicycle helmets. This may be done, for instance, to customize the helmet, or to retrofit helmets with such energy absorption features.

A composite slippage pad 20 may also be formed. Accordingly, the tubes 70 have the capacity of elastically returning to their initial unloaded shapes, for "lateral" movements of the free end portions of the tubes 70 (i.e., those away from the helmet connection), and for buckling.

Due to the cushioning and the deformation, the tubes 70 may provide a non-negligible level of friction with the wearer's head (skin and/or hair, or cap or fabric), such that an angled impact on the helmet 10 will result in geometrical deformation of the tubes 70 relative to the wearer's head. In other words, an angled impact on the helmet 10 may result in a movement resulting from deformation of the tubes 70 and relative movement of free ends of the tubes 70 relative to the inner liner 12. The web of interconnected tubes 70 forms a planar surface (though pierced), ensuring suitable friction between the wearer's head and the tubes 70. A high enough density of tubes 70 per surface unit of the base 30 may also assist.

Therefore, when an angled impact is made on the helmet 10, the slippage pads 20, in contact with various discrete locations of the wearer's head, will allow displacement of the inner liner 12 relative to the wearer's head, by deformation of the tubes 70, while the slippage pads 20 (e.g., via bases 30) generally remain at the discrete locations on the helmet. This displacement of the inner liner 12 relative to the wearer's head will lessen the rotational velocity movement on the wearer's head. The slippage pads 20 are independent from one another, as they are not concurrently related to an attachment device. In other words, each slippage pad 20 will enable local deformation independently of how the other slippage pads 20 react. As mentioned previously, the deformation may be in the form of flexion, distortion, shearing and/or buckling of the tubes 70.

Figure 10:
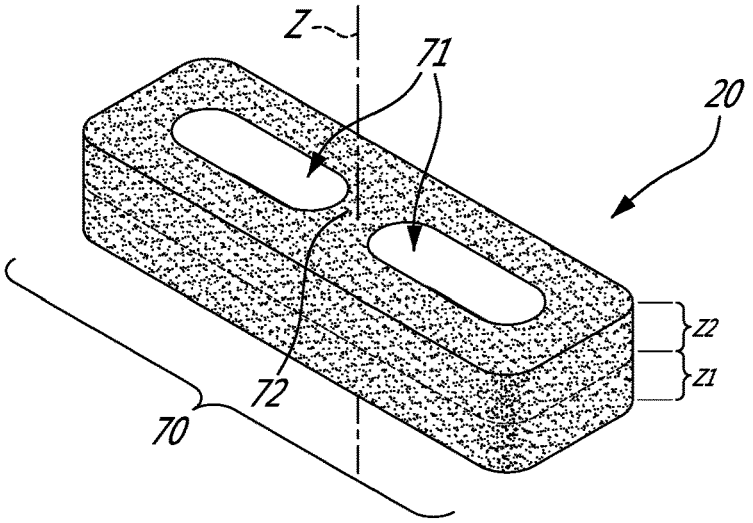
FIG. 10 is a perspective view of a slippage pad as used in FIG. 2, in accordance with another embodiment of the present disclosure.
Figure 11:
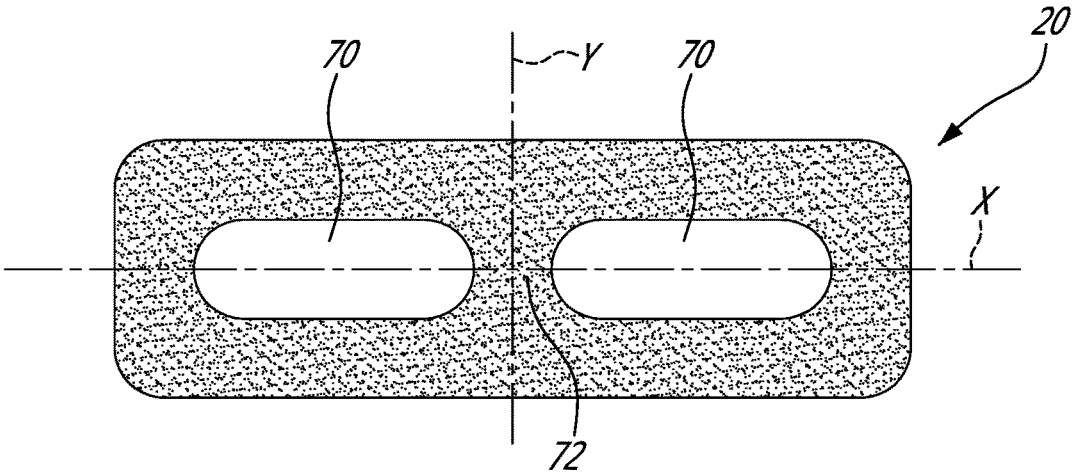
FIG. 11 is a top view of the slippage pad of FIG. 10.
Figure 12:
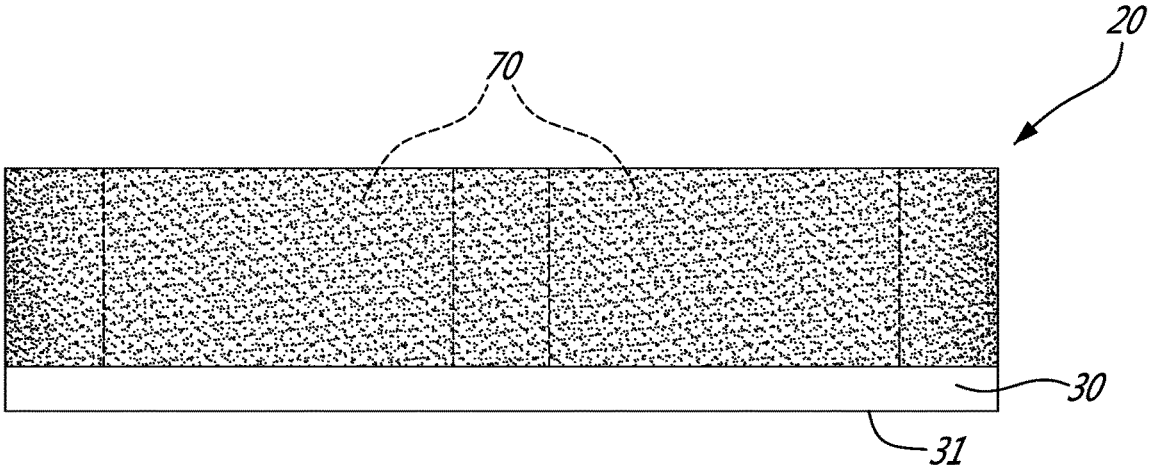
FIG. 12 is an elevation view of the slippage pad of FIG. 10.

Referring to FIGS. 10 to 12, another slippage pad 20 is shown, in accordance with another embodiment of the present disclosure. The slippage pad 20 shown in FIGS. 10 to 12 may share structural and functional similarities with the embodiments discussed above and below. As shown, and similar to the embodiment shown in FIGS. 7 and 8, the slippage pad 20 forms a series of tubes 70, interconnected to each other by a common wall 72. As shown, the slippage pad 20 has a pair of tubes 70 with their respective openings 71 made on their respective head contacting surface for being oriented towards the wearer's head when provided in the helmet 10 and when the helmet 10 is worn. The slippage pad 20 of FIGS. 10 to 12 has a generally rectangular outline, but other shapes are considered, such as oval. Stated differently, the slippage pad 20 has a sequence of openings 71, in this case obround holes (though other shapes are contemplated, including rectangular, with or without rounded corners), defined therethrough, opened toward the wearer's head. The openings 71 may have the same size, or a different size. The openings 71 are spaced apart from each other by the common wall 72 in between them. In an embodiment, such as shown, the slippage pad 20 has two openings 71 adjacent to each other. In an embodiment, the slippage pad 20 has a single row of openings 71. In other words, in an embodiment, the openings 71 are aligned in a single row extending along the length of the pad 20, shown as being along axis X). The openings 71 may have an elongated shape with a length of 15 mm±5 mm and a width of 5 mm±3 mm. In the embodiment shown, the common wall 72 between the adjacent openings 71 has a minimum longitudinal dimension (dimension taken along the length of the pad 20, shown as being along axis X) of 4 mm±2 mm. In an embodiment, the minimum longitudinal dimension of the common wall 72 is between 10% to 20%, inclusively of the length of the slippage pad 20 of FIGS. 10-12. Other dimensions may be contemplated for the openings 71 in other embodiments. The expression "minimum longitudinal dimension" is used considering that the wall 72 may not have a constant dimension, notably if the openings 71 are obround.

There may be more than two openings 71 per slippage pad 20 in other embodiments. The openings 71 may be evenly distributed in said slippage pad 20, although this may be different in other embodiments (non even distribution). The dimensions of the openings 71 may be defined as a ratio of their dimensions with a corresponding dimensions of the slippage pad 20. For instance, in an embodiment, a ratio of the sum of the length of the openings 71 over the length of the slippage pad 20 is 70%±20%. A ratio of the width of the openings 71 over the width of the slippage pad 20 may range between 25% and 40% —the width being along axis Y. Other ratios may be contemplated in other embodiments. As shown in FIG. 12, the slippage pad 20 may optionally have a base 30, with its undersurface 31, as discussed above with respect to other embodiments. Stated differently, the openings 71 may be through openings, i.e., open on opposed sides of the slippage pad 20 of FIGS. 10-12, but it is also contemplated to have the tubes 70 in a close-ended configuration, i.e., one end being closed, by way of the base 30. For example, the closed end could be the one against the inner liner 12, as this closed end could increase the bonding surface of the slippage pad 20 with the inner liner 12. The slippage pad 20 may be disposed at selected locations on the inner liner 12 of the helmet 10, as discussed above and shown in FIG. 2. Also, such slippage pad 20 may be combined with cushioning pads 15 distributed in the inner cavity of the helmet 10, in an alternating sequence of slippage pads 20 and cushioning pads 15, or otherwise, for instance. According to an embodiment, the slippage pad 20 of FIGS. 10-12 is monoblock. The base 30, if present, may or may not be part of the monoblock.

Figure 13:
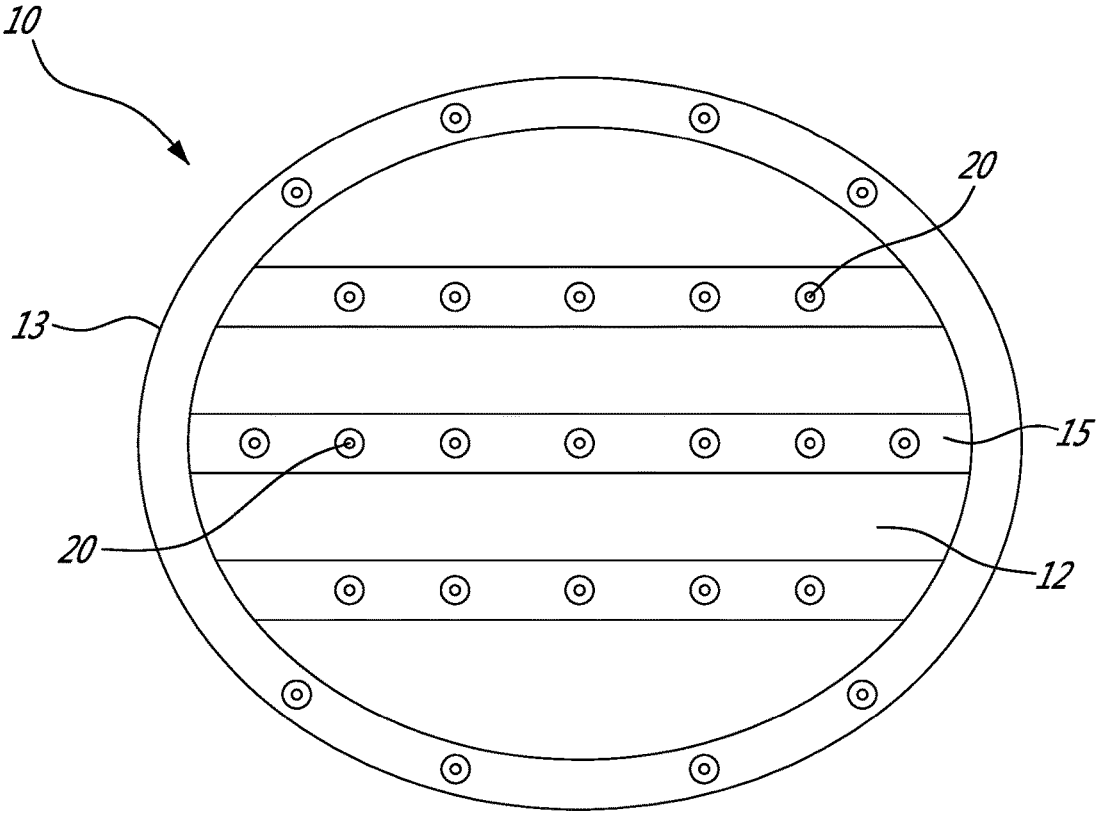
FIG. 13 is a schematic view of an inner cavity of the helmet of FIG. 1 showing a distribution of the slippage pads, in accordance with another embodiment.

Referring to FIG. 13, there is shown a schematic view of an inner cavity of the helmet 10 according to another embodiment. The helmet has the outer shell 13, inner liner 12, and cushioning pad(s) 15, similar to that discussed above. As shown, slippage pads 20 are distributed in the inner cavity of the helmet 10, such as to individually face discrete portions of the wearer's head when the helmet 10 is worn. The slippage pads 20 may have different shapes, such as the ones described later.

Figure 14:
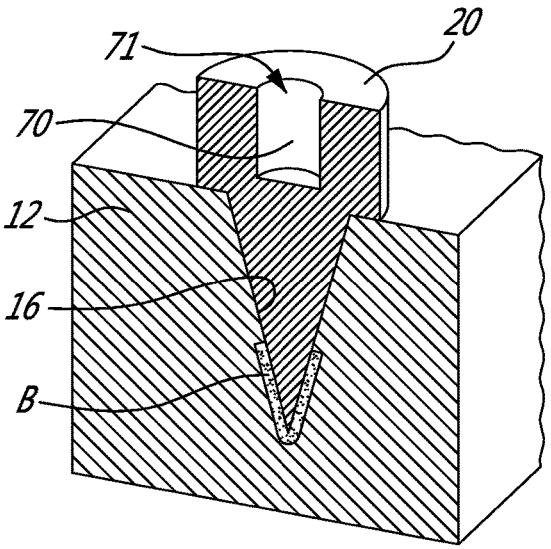
FIG. 14 is a perspective view of a slippage pad as used in FIG. 13, in accordance with another embodiment.
Figure 15:
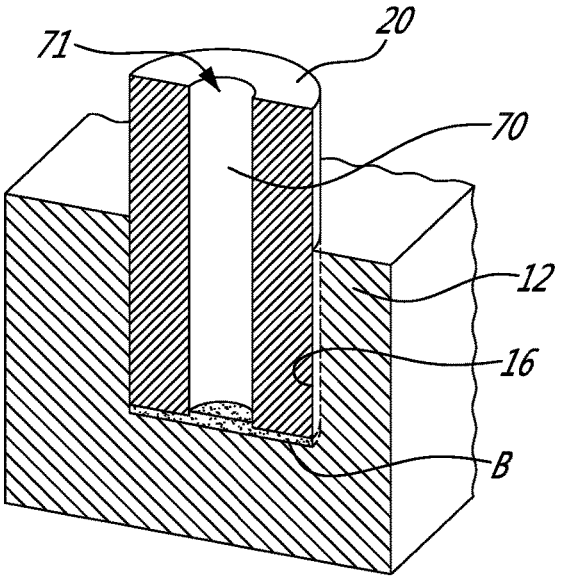
FIG. 15 is a sectional elevation view of a slippage pad as used in FIG. 13, in accordance with another embodiment.

FIGS. 14 and 15 show how the slippage pads 20 may be mounted into the helmet 10. More specifically, a bottom portion of the slippage pad 20 is received in a recess 16 defined within the inner liner 12 (inner liner 12 or cushioning pad 15 where the slippage pad 20 is directly mounted on the cushioning pad 15). At least part of the bottom portion of the slippage pad 20 may be adhesively bonded to the inner liner 12 or cushioning pad 15. For instance, the bonding zones B shown in FIGS. 14 and 15 are located at the bottommost portion of the slippage pad 20 only. This may allow the remainder of the bottom portion of the slippage pad 20—i.e., one that is unattached to the inner liner 12—just as the top portion of the slippage pad 20, to deform "laterally", stretch, buckle, distort, and/or shear when an angled impact (e.g. angled force or tangential force relative to a longitudinal axis of the slippage pad 20) is made on the helmet 10, even though the bottom portion is in the recess 16 and surrounded by inner liner 12 or cushioning pad 15 material. In other words, the peripheral surface of the bottom portion, where it is not adhesively bonded or physically attached to the liner 12, may move toward and away from the recess 16 wall when the slippage pad 20 deforms. Other ways for securing the slippage pads 20 to the inner liner 12 or cushioning pad 15 may also be contemplated, such as mechanical interlock due to interlocking shapes of the slippage pads 20 and the recess 16, for instance.

Also, as shown, the slippage pads 20 may or may not have an opening 71 extending all the way through the length of the slippage pad 20. In the embodiment shown in FIG. 15, the slippage pad 20 defines a tube 70 that extends through the full length of the slippage pad 20.

In operation, when an angled impact is made on the helmet 10, the slippage pads 20, in contact with various discrete locations of the wearer's head, allow displacement of the inner liner 12 relative to the wearer's head, by deformation of the slippage pads 20, while the slippage pads 20 remain bonded to the inner liner 12 or cushioning pad 15, and the bottom portions of the slippage pads 20 remain in a respective recess 16. While the slippage pads 20 are deforming, for instance "laterally", the slippage pads 20 may compress to absorb energy from the angled impact. As they deform, a gap may be created between the recess wall and the peripheral surface of the bottom portion of the slippage pad 20. Thus, at least part of the peripheral surface of the bottom portion moves away from the recess 16 wall while an opposite part of the peripheral surface of the bottom portion is compressed against the recess 16 wall as a result of the deformation of the slippage pad 20. Although in the embodiments shown in FIGS. 14 and 15 the bottom portion of the slippage pad 20 has a size and shape corresponding to the shape and size of the recess 16 in which it is received, this may be different in other embodiments. For instance, the recess 16 may be larger than the bottom portion of the slippage pad 20, such that only the bottommost portion of the slippage pad 20 that is secured to the inner liner 12 or cushioning pad 15 contacts the recess 16 wall, when the slippage pad 20 is in an non-deformed state. This may allow the bottom portion to expand laterally when the slippage pad 20 is compressed longitudinally, which may increase the amount of energy absorption due to angled impact, for instance. In other cases, the recess 16 may be smaller than the bottom portion of the slippage pad 20, such that the bottom portion does not entirely recede within the recess 16.

Referring to FIGS. 16 to 24, embodiments of the slippage pads 20 used in the helmet 10 shown in FIG. 13 are shown and vary in one or more structural characteristics, as discussed below.

Figure 16:
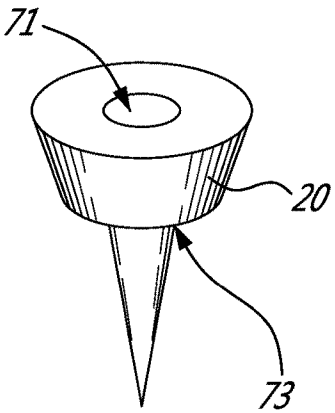
FIGS. 16-23 are perspective views of embodiments of slippage pads as used in FIG. 13.

As shown in FIG. 16, the slippage pad 20 may have a varying cross-section shape and/or a uniform cross-section with varying dimensions, along its length. More particularly, the slippage pad 20 may have a circular cross-section that decreases progressively towards an end of the slippage pad 20 and converges to form an apex (or pointed shape) at its end. The slippage pad 20 shown includes an opening 71 at its top end, such as discussed above with respect to other embodiments. In this embodiment, the opening 71 does not extend all the way through the length of the slippage pad 20 (i.e. a hole is formed on the top end of the slippage pad 20, and such hole has a closed end). Also shown, the slippage pad 20 defines a shouldered portion 73 configured to abut against a corresponding surface of the inner liner 12 (inner liner 12 or cushioning pad 15 where the slippage pad 20 is directly mounted on the cushioning pad 15). As such, when mounted in the helmet 10, an upper portion of the slippage pad 20 protrudes from the concave inner surface of the inner liner 12 as the shouldered portion 73 abuts against the inner liner 12 or cushioning pad 15.

Figure 17:
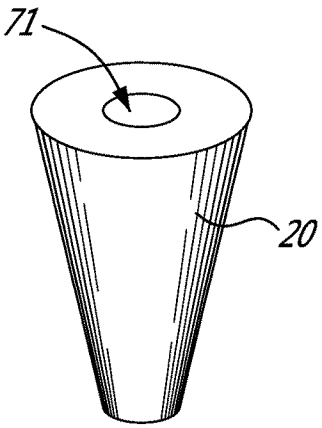
Figure 18:
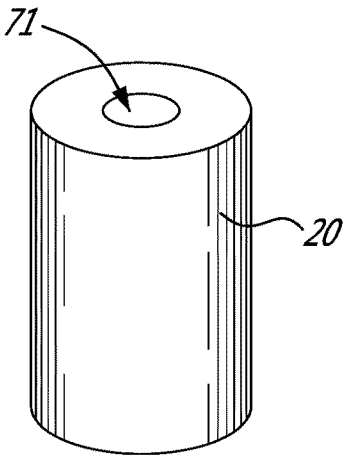
Figure 19:
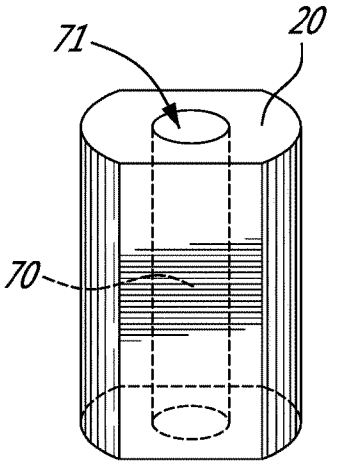
Figure 21:
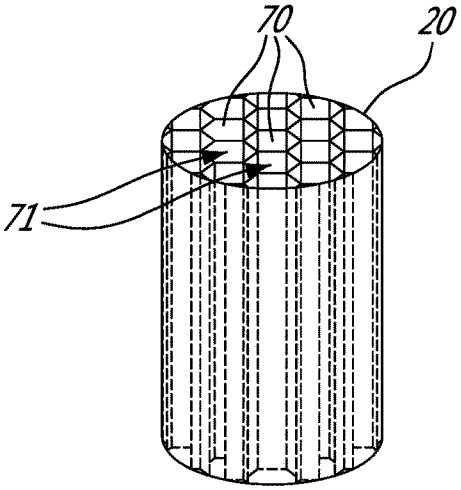

As shown in FIG. 17, and similar to the embodiment shown in FIG. 16, the slippage pad 20 has an opening 71 defined at a top end thereof. The slippage pad 20 has varying cross-sectional dimensions, and in this case a circular shape (though other cross-section shape is contemplated), which progressively decreases toward a bottom end of the slippage pad 20. In another embodiment, the slippage pad 20 may have a constant cross-section along its length, such as shown in FIGS. 18, 19 and 21. In the embodiment shown in FIG. 18, the slippage pad 20 has an opening 71 that does not go all the way through the length of the slippage pad 20. This is different in FIG. 19, where the opening 71 extends through the slippage pad 20 completely. Also, the example shown in FIG. 19 has an oblong shape.

Figure 20:
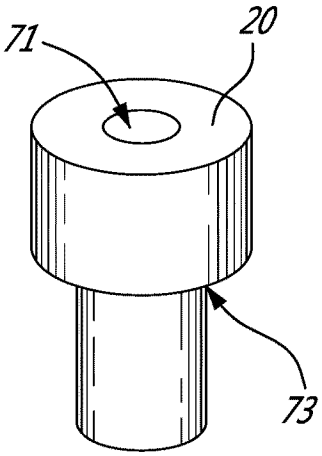

The embodiment of the slippage pad 20 shown in FIG. 20, similar to the embodiment shown in FIG. 16, has a shouldered portion 73 configured to abut against the concave inner surface of the inner liner 12 or cushioning pad 15. As shown, the slippage pad 20 has an opening 71 such as discussed above with respect to other embodiments. The slippage pad 20 also has a generally cylindrical shape with a cross-section that varies along the length of the slippage pad 20.

In an embodiment, as shown in FIG. 21, the slippage pad 20 has a generally circular shape, though other cross-sections, such as a honeycomb cross-section, are contemplated. In this embodiment, the slippage pad 20 includes a plurality of side-by-side tubes 70 forming the body of the slippage pad 20. Similar to the embodiment shown in FIGS. 7 and 8, the tubes 70 have an hexagonal cross-section, with adjacent tubes 70 sharing walls to form a honey-comb style structure, i.e. with openings 71 facing the head of the wearer. In this embodiment, when an angled impact is made on the helmet equipped with such slippage pads 20, the walls between adjacent tubes 70 distort, buckle or otherwise deform to absorb impact energy.

Figure 22:
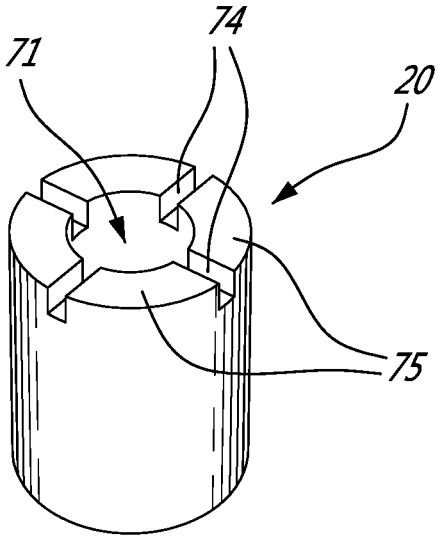

Referring to FIG. 22, similar to the embodiment shown in FIG. 18, the slippage pad 20 has a generally circular shape with a cross-section with constant (constant or substantially constant) dimensions along the length of the slippage pad 20. The slippage pad 20 has an opening 71 defined at a top end thereof. The opening 71 does not go all the way through the length of the slippage pad 20. This may help deflect, shear, compress or otherwise deform the slippage pad 20 and/or allow for a reduction of the weight of the slippage pad 20 compared to variants of the slippage pad 20 without opening 71.

As shown, the slippage pad 20 has slits 74 defined at an head-contacting end thereof. The slits 74 define a crown portion configured to contact the wearer's head. As shown, in this case, the slippage pad 20 has a pair of slits 74 extending from side to side of the pad 20 and transversally from each other. As such, the pair of slits 74 form four segments 75 in the end of the slippage pad 20. In this case, the segments 75 are arcuate segments. Stated differently, the slits 74 may define a cruciform shape at the end of the slippage pad 20. The segments 75 may each deform individually to distribute pressure and/or decrease pressure points on the head over slippage pad 20 with a flat end.

Although four segments 75 are shown in FIG. 22, there may be more or less segments 75 and/or slits 74 defined at the end of the slippage pad 20. Additionally or alternately, the segments 75 may have different shape than the illustrated arcuate shape, depending on the cross-section shape and/or cross-section dimensions of the slippage pad 20, for instance. The slits 74 and segments 75 may also be present in embodiments of the slippage pad 20 without opening 71.

Figure 23:
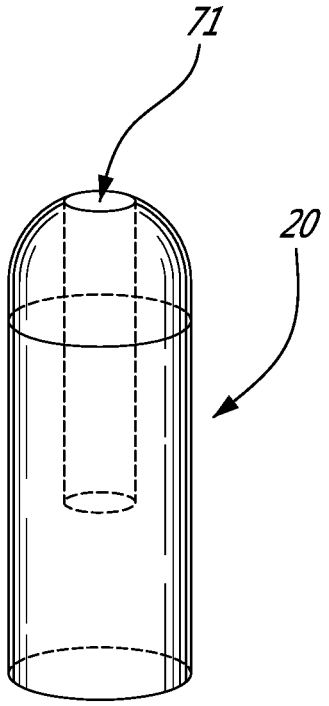

In addition to or instead of the crown portion formed by the slits 74, the slippage pad 20 may have a rounded top end. That is, the end of the slippage pad 20, with or without the slits 74, which is contactable with the wearer's head may have an hemispherical shape when viewed from a side elevational view. This is shown in FIG. 23. Such rounded shape may improve comfort over a slippage pad 20 with a flat end, when in contact with the wearer's head.

Figure 24:
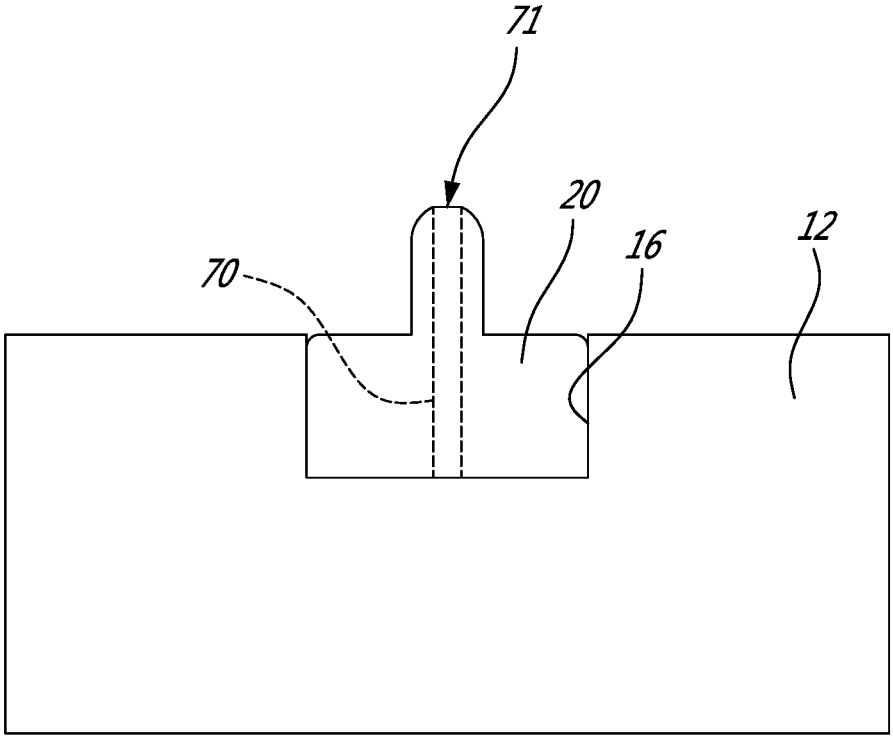
FIG. 24 is a sectional elevation view of a slippage pad as used in FIG. 13, in accordance with another embodiment.

Referring to FIG. 24, a slippage pad 20 secured to an inner liner 12 portion is depicted, according to another embodiment. The slippage pad 20 has a bottom portion secured in a recess 16 defined within the inner liner 12. The slippage pad 20 has an upper portion that protrudes from the concave inner surface of the inner liner 12, out from the recess 16. The monikers "bottom" and "upper" are used because of the orientation of FIG. 24. However, such monikers should be understood to mean the orientation of the slippage pad 20 when the helmet 10 is worn. In fact, the slippage pad 20 is often oriented upside down or sideways relative to the orientation of FIG. 24, when the helmet is worn 10. As shown, the slippage pad 20 has a constant cross-section shape that varies in dimensions along its length. The upper and bottom portions may have a circular cross-section shape, though the cross-section shape may be different between the bottom portion (e.g., square) and the upper portion (e.g., round). The upper portion has a smaller diameter than a diameter of the bottom portion. In other words, a cross-sectional area of the upper portion is smaller than a cross-sectional area of the bottom portion (i.e. cross-sectional areas taken along a plane perpendicular to a longitudinal axis of the slippage pad 20). In this case, similar to FIG. 23, the top end of the upper portion of the slippage pad 20 has a rounded shape or rounded edges.

For instance, in some cases, the cross-sectional area of the bottom portion is twice the cross-sectional area (i.e. cross-sectional area of the upper portion below the rounded edges of the top end, if present) of the upper portion, in some cases thrice the cross-sectional area of the upper portion, and in some cases the cross-sectional area of the bottom portion is even greater. This may apply also in embodiments where the cross-section shape(s) of either one or both of the upper and lower portions is not circular (e.g. polygonal cross-section shape, irregular cross-section shape, etc.).

In some variants, the upper and bottom portions may have different cross-section shape, such that the upper portion may have a first cross-section shape and the bottom portion may have a second cross-section shape different from the first cross-section shape, though the upper and bottom portions may have the same cross-section shape and simply vary with respect to their respective dimensions. For instance, in some cases, the cross-section of the upper portion has a circular shape and the cross-section of the bottom portion has a polygonal shape. The respective cross-sections of the upper and bottom portions may be different in other cases.

The upper portion defines a flexion zone and the bottom portion defines an impact energy absorption zone of the slippage pad 20. The upper portion contacts the wearer's head when the helmet 10 is worn. The upper portion may adapt to the wearer's head shape due to its flexibility. Due to its relatively small cross-sectional area, the upper portion may flex, buckle, shear or otherwise deform while the helmet is donned and/or upon light loading (e.g. light impact load or simply a load exerted by the wearer's head when the helmet 10 is donned). The transverse rigidity of the upper portion being relatively low, the upper portion of the slippage pad 20 allows a relative slippage motion between the wearer's head and the inner surface of the inner liner 12. This motion, in combination with the energy-absorbing characteristics of the slippage pad 20 may contribute to absorb energy from angled impacts made on the helmet 10 and transferred to the wearer's head. Also shown in FIG. 24, the slippage pad 20 has an opening 71 that extends through the slippage pad 20, thereby defining a tube 70 extending through the slippage pad 20. Such hollowed configuration of the slippage pad 20 provides flexibility to the upper portion (less transverse rigidity) and/or reduce the weight of the slippage pad 20. In some variants, the opening 71 may not extend through the slippage pad 20, such that the opening 71 has a finite depth. Additionally or alternately, the slippage pad 20 may have more than one opening 71, such as a series of side-by-side openings 71.

The bottom portion of the slippage pad 20 is contained and secured within the recess 16. The bottom portion may be secured in the recess 16 by any suitable manner, such as adhesively bonding, co-molding, injection molding, inserting the bottom portion in friction or tight fit within the recess 16, for instance. The bottom portion may absorb energy from angled impacts by deforming in compression and/or shear. The bottom portion is made of a viscoelastic material. In a particular embodiment, the viscoelastic material is a non-Newtonian polymer, such as the non-Newtonian polymer known as DCLAN gel. Other viscoelastic or energy-absorbing materials may be contemplated, as those discussed above with respect to other embodiments. The upper portion may be made of the same material than the bottom portion, though a different material may be used for the upper portion.

Figure 25:
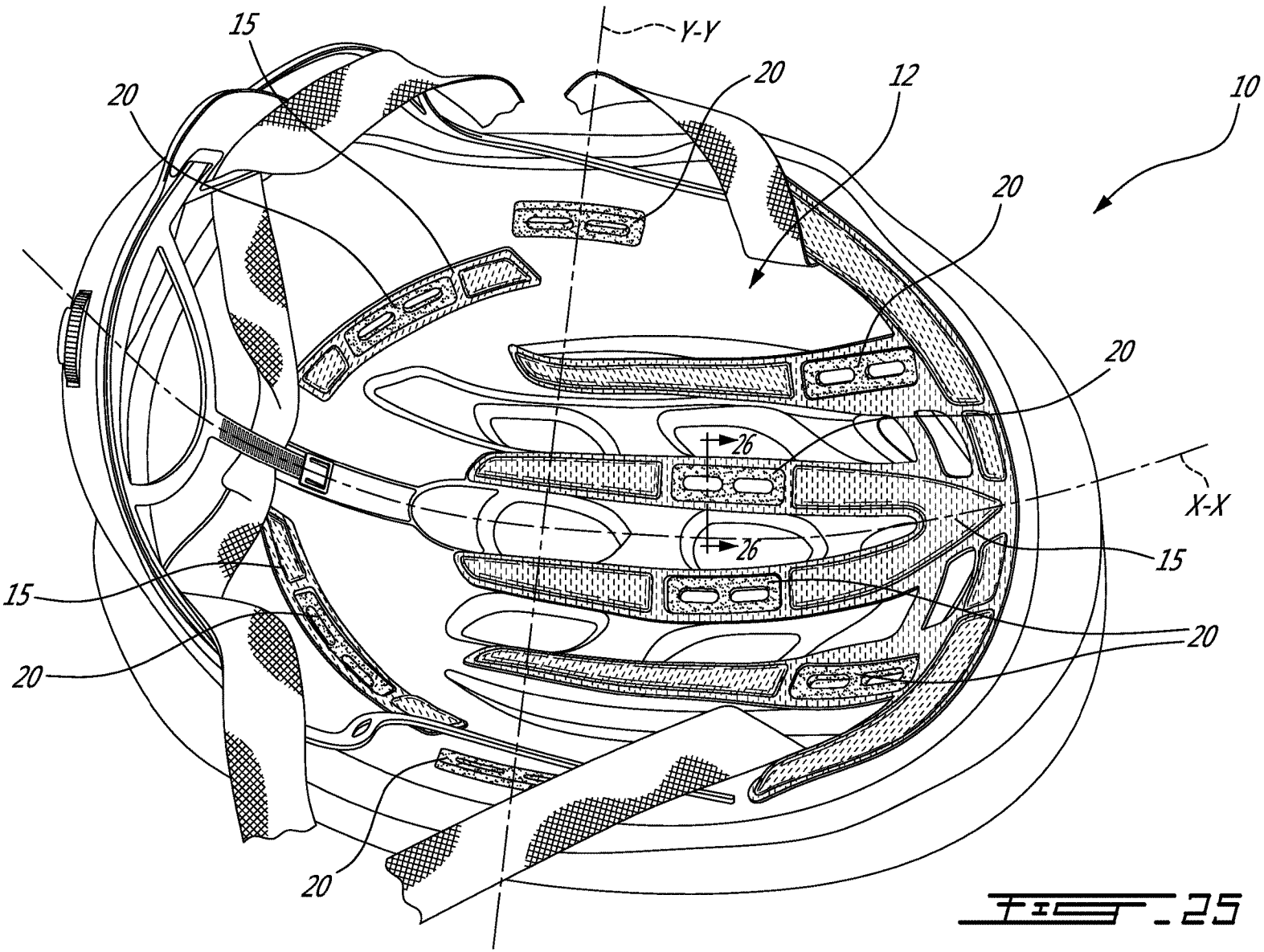
FIG. 25 is a perspective view of an inner cavity of the helmet of FIG. 1 showing a distribution of the slippage pads, in accordance with some embodiments.

Referring to FIG. 25, there is shown an inner cavity of the helmet 10 having a number of slippage pads 20 of the type shown in FIGS. 10 to 12, disposed at selected locations on the inner liner 12 of the helmet 10. Though the slippage pads 20 of FIGS. 10-12 are shown in FIG. 25, other embodiments of the slippage pads 20 may also be used as alternatives to the ones of FIGS. 10-12. There is also shown cushioning pads 15 disposed on the inner liner 12. The cushioning pads 15 are removably connected to the inner liner 12, such as, by Velcro™. The cushioning pads 15 may also be connected in other ways or in supplemental ways to the helmet 10 in other embodiments, such as by adhesive bonding or other means for permanently and/or releasably connecting the cushioning pads 15 to the inner liner 12. As shown, the cushioning pads 15 may define apertures that correspond in shape and dimensions to the slippage pads 20, for the slippage pads 20 to be surrounded by the cushioning pads 15, if desired. In such arrangement, there may or may not be direct connection between the cushioning pads 15 and the slippage pads 20. Some or all of the slippage pads 20 may be disposed within the apertures of the cushioning pads 15, though this is optional. The cushioning pads 15 may thus contour at least some of the slippage pads 20. This may improve comfort of the helmet 10 having such slippage pads 20, as the cushioning pads 15 and the slippage pads 20 may form a continuous head contacting surface that contacts the wearer's head when the helmet 10 is worn. The cushioning pads 15 may not have such apertures in other embodiments, for instance, where the cushioning pads 15 and the slippage pads 20 are distributed in an alternating sequence of slippage pads 20 and cushioning pads 15, or otherwise, as discussed above. The helmet 10 may be without cushioning pads 15 altogether.

As shown, the slippage pads 20 are connected to the inner liner 12. The slippage pads 20 may be connected to the inner liner 12 by adhesive bonding. Other ways to secure the slippage pads 20 to the inner liner 12 may be contemplated in other embodiments, such as co-molding, mechanical interlocking or via mechanical connectors, such as mechanical fasteners. As shown, the slippage pads 20 are directly connected to the inner liner 12. In other embodiments, the slippage pads 20 may be connected to an intermediary piece of material, such as the web 80 discussed above, or a layer of material such as a layer of woven material, interconnecting the slippage pads 20 together. This may facilitate handling of the slippage pads 20 as a cluster of slippage pads 20 during manufacturing and/or assembly of the helmet 10, amongst other things.

Figure 26:
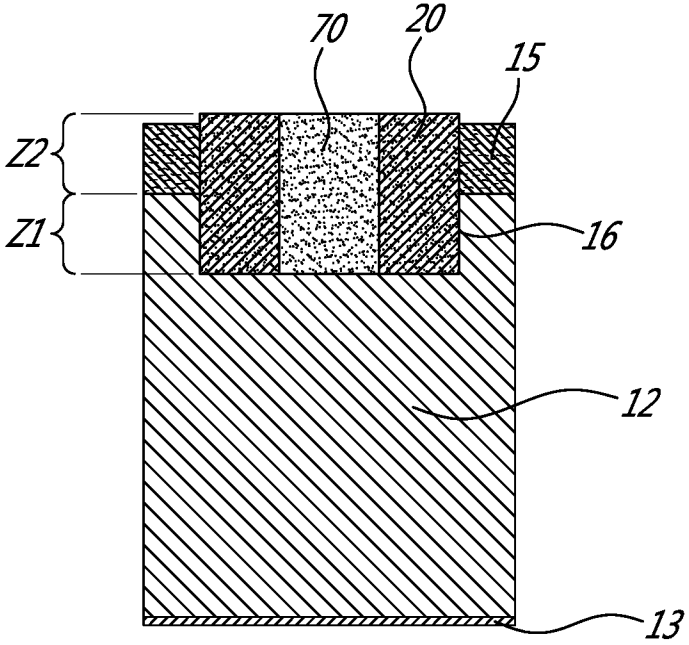
FIG. 26 is a cross-sectional view of a portion of the helmet of FIG. 1, taken along the plane 26-26 of FIG. 25.

In an embodiment, the slippage pads 20 have a base portion Z1 along axis Z (FIG. 10) received in respective recesses 16 defined within the inner liner 12, with a head contacting portion Z2 projecting beyond a plane of the inner liner 12. This is illustrated in a cross-sectional view of a portion of the helmet 10 in FIG. 26, according to an embodiment. The recesses 16 and the slippage pads 20 may be dimensioned to be in a close fit fashion, which may allow the slippage pads 20 to be "laterally" retained on the inner liner 12. This may help securing the slippage pads 20 to the inner liner 12 and/or provide a mechanical abutment between the slippage pads 20 and the inner liner 12, thereby reducing the shear stress in the adhesive bonding that may connect the slippage pads 20 to the inner liner 12, in embodiments where such adhesive bonding is present, during shear deformation of the slippage pads 20. In some variants, the recessed 16 may be dimensioned or shaped such that a peripheral space is provided between the recesses lateral walls and a periphery of the slippage pads 20. This may allow the slippage pads 20 to expand laterally while being compressed until the periphery of the slippage pads 20 abuts against the recess lateral walls.

The slippage pad 20 has the head contacting portion Z2 that protrudes from the concave inner surface of the inner liner 12, out from the recess 16. The recesses 16 may allow the slippage pads 20 to have a greater overall thickness, which may increase the energy absorption of the slippage pads 20, as opposed to embodiments where the inner liner 12 has no recess 16 receiving the slippage pads 20. The recesses 16 may thus allow the use of thicker slippage pads 20 while concurrently keeping the helmet 10 "compact", in that the inner liner 12 may still remain close to the wearer's head when the helmet 10 is worn. This may contribute to having a helmet 10 that appears less bulky on the wearer's head without compromising on the thickness of the slippage pads 20 between the wearer's head and the inner liner 12. In embodiments where the recesses 16 are present, a ratio of a recess depth over the thickness of the slippage pads 20 is no more than 1:2, (i.e., dimension of Z1 along axis Z over Z1+Z2). In some cases, such ratio may be no more than 1:3, and in some cases no more than 1:4. Other ratios are possible in other embodiments.

The dimensions of the slippage pads 20 may be any appropriate dimensions for use in a helmet 10. In an embodiment, the slippage pads 20 have an elongated shape with a length of 40 mm±20 mm (i.e., along axis X), and a width of 13 mm±7 mm (i.e., along axis Y). The slippage pads 20 may have other dimensions. A thickness of the slippage pads 20 may range between 2 mm and 10 mm (i.e., along axis Z). The slippage pads 20 may have other thickness dimensions in other embodiments. As shown, the slippage pads 20 all have the same dimensions and shape. However, this may be different in other embodiments, where at least some or all of the slippage pads 20 may be shaped and/or dimensions differently from one another.

The slippage pads 20 may be made of a composite material including polyurethane (PU) and a non-Newtonian polymeric material, such as the DCLAN™ gel discussed above, the D3O™ material, or another non-Newtonian material. In an embodiment, a density of such slippage pads 20 is 0.27 g/cm$^3$±0.10 g/cm$^3$. Other densities may be contemplated in other embodiments. The slippage pads 20 may be formed as an integral monolithic piece of a non-Newtonian polymeric material in other embodiments. Other materials, of non-Newtonian or Newtonian types may be contemplated in other embodiments. For instance, in other embodiments, the slippage pads 20 may be made of a polymeric material, such as silicone, polyethylene (PE), polypropylene (PP), thermoplastic polyurethane (TPU), rubber, with or without the addition of a non-Newtonian polymeric material. As discussed above, the non-Newtonian polymeric material may provide great energy absorption characteristics because of its rheological behaviour when subjected to an impact, as it may harden from a non-rigid state (i.e. a gel state) to form an impact protection layer while absorbing, at least partially, the impact energy. This may provide improved impact energy absorption when subjected to a low density energy impact and/or a high density energy impact, as the non-Newtonian polymer may rheologically respond differently to low impact energy and to high impact energy.

An angled impact on the helmet 10 having such slippage pads 20 may result in geometrical deformation of the tubes 70 relative to the wearer's head. In other words, an angled impact on the helmet 10 may result in a movement resulting from deformation of the tubes 70 and relative movement of the head contacting surface of the slippage pads 20 relative to the inner liner 12. Some or all of the slippage pads 20 may be subjected to local deformation independently of how the other slippage pads 20 react. The common reaction of the slippage pads 20, which may correspond to the sum of deformations of the slippage pads 20 disposed at selected locations on the inner liner 12 of the helmet 10, when an angled impact on the helmet 10 is made, may provide impact energy absorption via geometrical deformation of the slippage pads 20. As such, the amount of impact energy transmitted to the wearer's head may be less than that transmitted to the wearer's head when the slippage pads 20 are absent from the helmet 10, in some embodiments. The deformation of the slippage pads 20, as mentioned previously, may be in the form of flexion, compression, distortion, shearing and/or buckling of the tubes 70.

The helmet 10 defines a frontal portion for covering at least partially a frontal region of the wearer's head, a rear portion for covering a rear region of the head, opposite lateral portions for covering opposite lateral regions of the head, and a top portion for covering a top region of the head. With continued reference to FIG. 25, a number of slippage pads 20 may be disposed at selected locations within the cavity of the helmet 10, between the inner liner 12 and the wearer's head when the helmet 10 is worn, to contact respective portions of the wearer's head. As shown, there may be at least two slippage pads 20 in each of the frontal, rear, and top portions of the helmet 10 to locally contact the wearer's head, and at least one slippage pad 20 in each of the opposed lateral portions of the helmet 10. In an embodiment, such as shown, at least two slippage pads 20 are longitudinally disposed on each side of a sagittal plane X-X of the helmet 10 (FIG. 25), which bisects the inner cavity into opposite inner cavity lateral regions. The slippage pads 20 on each side of the sagittal plane X-X, located respectively in the frontal and top portions of the helmet 10, may be longitudinally oriented transversally (transversally or in some cases perpendicularly) to a frontal plane Y-Y (FIG. 25) of the helmet 10, which bisects the inner cavity of the helmet 10 in respective rear and frontal inner cavity regions. That is, the at least two slippage pads 20 may be longitudinally oriented in a front-to-rear direction of the helmet 10, their respective longitudinal projections extending between the opposite lateral portions of the helmet 10. In this disposition, the footprint of the slippage pads 20 may be generally longitudinally aligned with a force vector resulting from an angled impact oriented toward the frontal portion of the helmet 10. The force vector of the angled impact may have a linear component, which may be generally transverse to the convex outer surface of the helmet 10, that may induce compression deformation in the slippage pads 20 located in the front portion of the helmet 10. The force vector of the angled impact may also have a tangential component, which is tangent to the convex outer surface of the helmet 10 and aligned in a front-to-rear direction of the helmet 10, whereby the slippage pads 20 are induced with shearing deformation along the longitudinal dimension of their footprint. This may provide better friction/adherence of the head contacting surface of the slippage pads 20 with the wearer's head to cause the shearing deformation and/or allow a better transmission of the impact energy from the outer shell 13 to the slippage pads 20 in compression and/or shear to absorb the impact energy, at least partially, for instance.

Additionally, the at least one slippage pad 20 in the opposite lateral portions of the helmet 10 are located on the inner liner 12 at locations that intersect with the frontal plane Y-Y of the helmet 10. The at least two slippage pads 20 located in the rear portion of the helmet 10 are longitudinally oriented such that their respective longitudinal projections are transverse to the longitudinal projections of the slippage pads 20 of the frontal and top portions of the helmet 10. The individual position of the slippage pads 20 and their relative positions may be different in other embodiments.

The invention claimed is:

1. A helmet comprising:

at least an inner liner forming a body of the helmet, the inner liner having a concave inner surface defining a cavity configured for receiving a wearer's head;

a plurality of slippage pads disposed at selected locations on the concave inner surface and connected to the inner liner, the slippage pads having an elongated shape with a length and a width, the length being greater than the width, the slippage pads having an undersurface and a head contacting surface spaced apart from and opposite to the undersurface, the slippage pads each defining a number of integrally connected side-by-side tubes each having an opening at the head contacting surface adapted to be oriented toward the wearer's head, the openings aligned longitudinally along the length of the slippage pads, the openings opened toward the cavity, and an attachment system to attach the helmet to the wearer's head.

2. The helmet as defined in claim 1, wherein all the slippage pads are shaped and size to be identical to each other.

3. The helmet as defined in claim 1, wherein lateral pairs of the slippage pads are disposed on each side of a sagittal plane of the helmet.

4. The helmet as defined in claim 3, wherein the lateral pairs of the slippage pads are evenly laterally spaced apart from the sagittal plane of the helmet.

5. The helmet as defined in claim 1, wherein a frontal pair of the slippage pads is disposed in a frontal portion of the helmet.

6. The helmet as defined in claim 1, further comprising at least one cushioning pad disposed on the concave inner surface of the inner liner.

7. The helmet as defined in claim 6, wherein the cushioning pad has apertures defined therethrough, the apertures corresponding in shape and dimensions to the slippage pads, wherein some of the slippage pads are disposed within the apertures of the cushioning pad.

8. The helmet as defined in claim 1, wherein recesses are defined within the inner liner, the slippage pads having a base portion received in respective ones of the recesses, the slippage pads having a head contacting portion projecting beyond a surrounding surface of the inner liner.

9. The helmet as defined in claim 8, wherein the recesses and the slippage pads are dimensioned for lateral walls of the slippage pads to contact surfaces of the recesses.

10. The helmet as defined in claim 1, wherein the slippage pads have a length of 40 mm±20 mm, and a width of 13 mm±7 mm.

11. The helmet as defined in claim 1, wherein a thickness of the slippage pads ranges between 2 mm and 10 mm.

12. The helmet as defined in claim 1, wherein a density of the slippage pads is 0.27 g/cm3±0.10 g/cm3.

13. The helmet as defined in claim 1, wherein the slippage pads are made of a composite material including polyurethane and a non-Newtonian polymeric material.

14. The helmet as defined in claim 1, wherein the plurality of tubes is a pair of tubes, the openings of the pair of tubes each having an obround shape.

15. The helmet as defined in claim 1, wherein the openings have a length of 15 mm±5 mm and a width of 5 mm±3 mm.

16. The helmet as defined in claim 1, wherein a ratio of the sum of a length of the openings over the length of the slippage pad is 70%±20%.

17. The helmet as defined in claim 1, wherein a ratio of a width of the openings over the width of the slippage pad range between 25% and 40%.

18. The helmet as defined in claim 1, wherein at least a first and a second one of the slippage pads are longitudinally oriented in a front-to-rear direction of the helmet, the at least two slippage pads having a respective longitudinal projection extending between the opposite lateral portions of the helmet.

19. The helmet according to claim 1, wherein the inner liner is made of expanded polystyrene.

20. The helmet according to claim 1, wherein the attachment system includes a strap element anchored to the body of the helmet.

21. The helmet according to claim 1, wherein the slippage pads define blocks of resilient material.

22. A helmet comprising:

at least an inner liner forming a body of the helmet, the inner liner having a concave inner surface defining a cavity configured for receiving a wearer's head;

a plurality of slippage pads disposed at selected locations on the concave inner surface and connected to the inner liner, the slippage pads defining blocks of resilient material, the blocks being monoblock pieces made of a single material, the blocks having an elongated shape with a length and a width, the length being greater than the width, the blocks having an undersurface and a head contacting surface on opposite sides of the blocks, the blocks each having a number of integrally connected side-by-side tubes each having an opening defined in the head contacting surface and opened to the cavity, the openings adapted to be oriented toward the wearer's head, the openings aligned longitudinally along the length of the blocks and an attachment system to attach the helmet to the wearer's head.

* * * * *